US006321153B1

(12) United States Patent
Rocke et al.

(10) Patent No.: US 6,321,153 B1
(45) Date of Patent: Nov. 20, 2001

(54) METHOD FOR ADJUSTING A PROCESS FOR AUTOMATED BUCKET LOADING BASED ON ENGINE SPEED

(75) Inventors: David J. Rocke, Eureka; Andrew G. Shull, Washington, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/590,874

(22) Filed: Jun. 9, 2000

(51) Int. Cl.[7] ..... G06F 7/70
(52) U.S. Cl. ..... 701/50; 172/4.5
(58) Field of Search ..... 701/50, 124; 172/1, 172/10, 12, 4.5, 9, 2; 37/348, 414, 419, 116, 347, 443; 414/698, 730, 694, 708

(56) References Cited

U.S. PATENT DOCUMENTS 4,518,044 * 5/1985 Wiegardt et al. ..... 172/7
5,214,916 * 6/1993 Lukich ..... 60/431
5,528,843 * 6/1996 Rocke ..... 37/348
5,720,358 * 2/1998 Christensen et al. ..... 180/53.4
5,968,103 10/1999 Rocke ..... 701/50
6,065,904 * 5/2000 Cook et al. ..... 405/303

* cited by examiner

*Primary Examiner*—William A. Cuchlinski, Jr.
*Assistant Examiner*—Marthe Y. Marc-Coleman
(74) *Attorney, Agent, or Firm*—Steve D. Lundquist

(57) ABSTRACT

A method for adjusting a process for automated bucket loading of a work machine having an engine and a work implement. The work implement includes a bucket. The method includes the steps of determining when the bucket engages a pile of material, initiating the automated bucket loading process in response to the bucket engaging the pile of material, determining an actual engine speed relative to a full engine speed, and adjusting a lift velocity command to the work implement, the lift velocity command adjustment being made as a function of a comparison of the actual engine speed to full engine speed.

4 Claims, 2 Drawing Sheets

METHOD FOR ADJUSTING A PROCESS FOR AUTOMATED BUCKET LOADING BASED ON ENGINE SPEED

TECHNICAL FIELD

This invention relates generally to a method for adjusting a process for an automated bucket loading cycle for a digging operation and, more particularly, to a method for adjusting the process as a function of variations in engine speed.

BACKGROUND ART

Earthworking machines, for example, wheel loaders, track loaders, and the like, having work implements, such as buckets, are often used to dig material from one location, and dump the material at one or more other locations. For example, wheel loaders having buckets are used to dig materials such as gravel, sand, soil, and the like, and dump the material into the bed of a truck, or at other sites.

In a work environment in which the dig and dump process is performed repeatedly for long periods of time, it is desired to work as efficiently and productively as possible. However, as fatigue sets in, or if the operator is relatively inexperienced, the dig cycle may not be as productive as desired. Furthermore, some work environments may be harsh for human operators, due to such factors as dust, weather, and adverse surroundings.

As a result, attempts have been made to automate the dig process to maximize productivity and efficiency. For example, in commonly-owned U.S. Pat. No. 5,968,103, Rocke discloses a system and method which automates the loading process of a work machine, such as a wheel loader, by monitoring various crowd factors as the bucket of the machine enters a pile of material. During the initial phase of the process, the system determines that the bucket has entered the pile, and responsively begins to lift the bucket rapidly. The lifting action of the bucket causes the front end of the work machine to be pushed downward, thus maintaining traction with the ground as the machine continues to push into the pile. The system then tilts the bucket back as it continues lifting in a controlled manner, thus loading the bucket to capacity.

The system disclosed by Rocke is designed to work with the engine of the work machine at full throttle. However, there are situations where it is desired to push into a pile of material with the engine at some speed less than full throttle. For example, the ground may be wet or sandy, and thus not able to provide good traction. Maintaining the engine at full speed may then cause the work machine to slip excessively as it enters the pile.

When the engine is operated at less than full speed, however, the invention disclosed and claimed by Rocke continues to command the same lift velocity as before. This results in the bucket rising out of the pile too quickly, thus causing the automated dig cycle to no longer load the bucket to capacity. It is desired therefore, to improve the invention disclosed by Rocke to adjust the automated bucket loading cycle to compensate for variations in engine speed.

The present invention is directed to overcoming one or more of the problems as set forth above.

DISCLOSURE OF THE INVENTION

In one aspect of the present invention a method for adjusting a process for automated bucket loading of a work machine having an engine and a work implement is disclosed. The work implement includes a bucket. The method includes the steps of determining when the bucket engages a pile of material, initiating the automated bucket loading process in response to the bucket engaging the pile of material, determining an actual engine speed relative to a full engine speed, and adjusting a lift velocity command to the work implement, the lift velocity command adjustment being made as a function of a comparison of the actual engine speed to full engine speed.

BEST MODE FOR CARRYING OUT THE INVENTION

Figure 1:
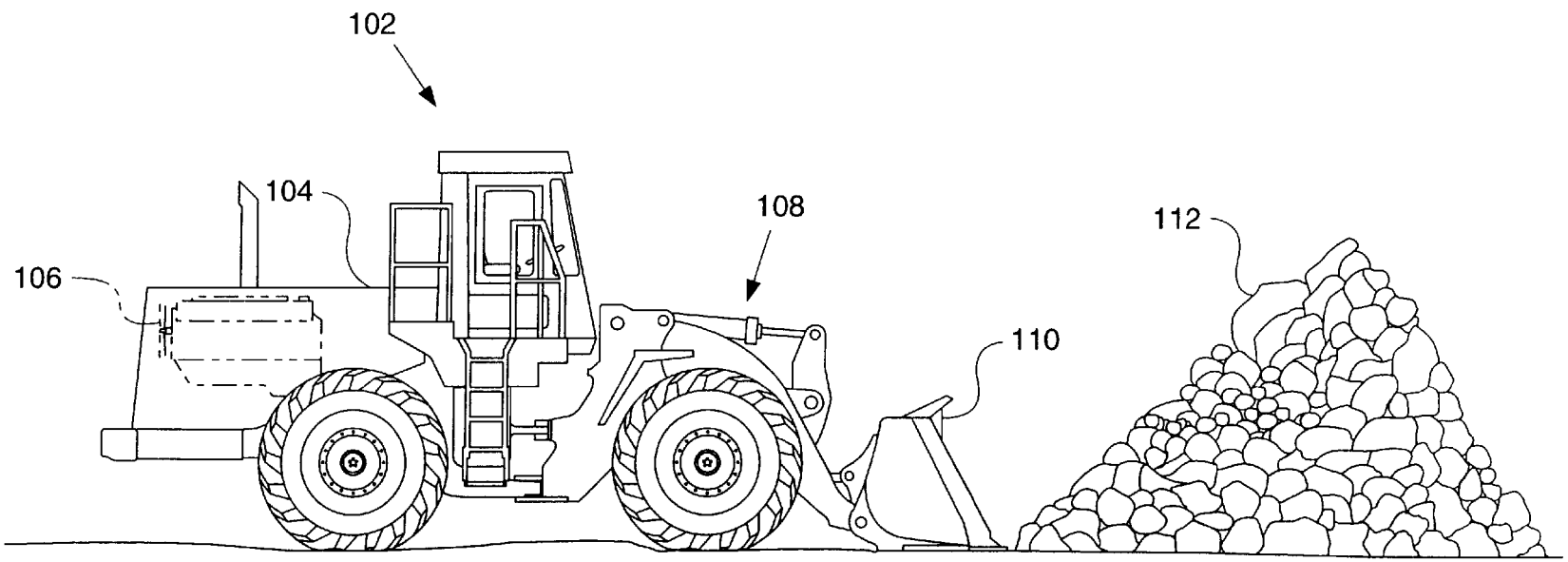
FIG. 1 is a diagrammatic illustration of a work machine engaging a pile of material.

Referring to FIG. 1, a work machine 102 is illustrated engaging a pile of material 112. The work machine 102 is depicted as a wheel loader 104. However, other types of work machines, e.g., track loaders, backhoe loaders, excavators, front shovels, and the like, may be used as well with the present invention.

The pile of material 112 may be any of a variety of materials that are to be loaded at the pile 112 and dumped at another location. For example, the pile 112 may include gravel, sand, dirt, and the like. Typically, the present invention works well if the pile of material 112 is an aggregate, such as a pile of gravel.

In the preferred embodiment, the work machine 102 is powered by an engine 106, such as an internal combustion engine. In addition, the work machine 102 includes a work implement 108, preferably having a bucket 110 attached for digging and loading. In the example of the wheel loader 104, the work implement 108 is preferably powered and controlled by hydraulic systems (not shown) as is well known in the art.

In commonly-owned U.S. Pat. No. 5,968,103, Rocke discloses a system and method for automating bucket loading of a work machine 102 using crowd factors, i.e., various machine parameters which are monitored to determine the degree of crowding of the pile of material 112. The present invention is an improvement of an automated bucket loading routine, such as the one disclosed by Rocke.

The system and method of Rocke monitors parameters such as torque of the work machine 102, wheel slip, ground speed, and the like to determine the forces being placed on the bucket 110 as the work machine 102 approaches the pile of material 112. When the monitored parameters indicate that the bucket 110 has entered the pile 112, the automated bucket loading process is initiated.

The automated bucket loading process commences by lifting the bucket 110 rapidly, while beginning to tilt the bucket 110 back, i.e., "racking"the bucket 110. The rapid lifting of the bucket 110 creates forces which tend to push the work machine 102 downward, which adds needed traction as the work machine 102 continues to push forward into the pile 112.

When the monitored crowd factors indicate that the bucket 110 has loaded to a desired amount, the automated system quickly racks the bucket 110 all the way back while completing the process of lifting the bucket 110 out of the pile 112. The work machine 102 is then ready to leave the pile 112 with a fully loaded bucket 110 for dumping elsewhere.

The system and method of Rocke is designed to lift the bucket 110 as rapidly as possible upon initial contact of the bucket 110 with the pile of material 112. This rapid lifting of the bucket 110 is in cooperation with the engine 106 operating at full speed. However, there are situations in which it is desired to operate the engine 106 at less than full speed. For example, if the ground is wet, the work machine 102 may lose traction if the work machine 102 approaches and engages the pile 112 with the engine 106 at full speed. Therefore, an operator may operate the engine 106 at a reduced speed to maintain traction. As another example, an operator may prefer to operate the engine 106 at less than full speed to extend the useful life of the engine 106.

When the engine 106 is operating at less than full speed in the system of Rocke, the rapid lifting of the bucket 110 at initial contact of the pile 112 is no longer in cooperation with the speed of the engine 106. As a result, the bucket 110 lifts out of the pile of material 112 too quickly, and the bucket 110 is no longer able to capture a full load.

Figure 2:
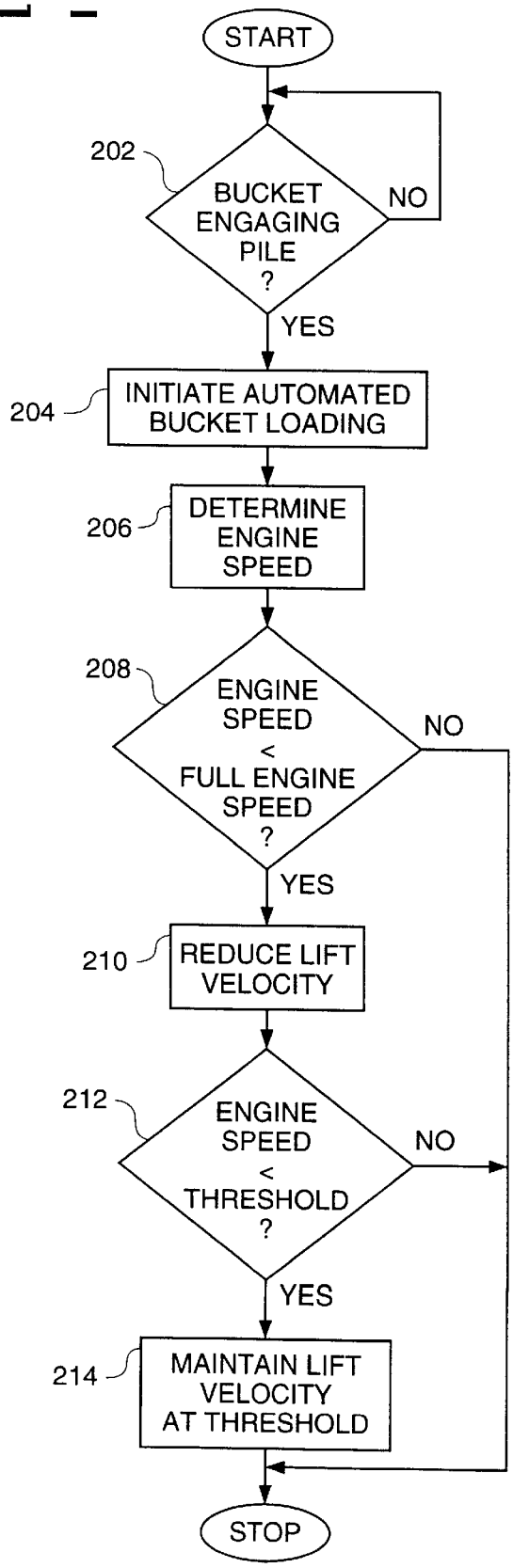
FIG. 2 is a flow diagram illustrating a preferred aspect of the present invention.

The present invention, as illustrated in the flow diagram of FIG. 2, is designed to establish the cooperation between the speed of the engine 106 and the lifting speed of the bucket 110 upon initial contact with the pile 112 so that the bucket 110 is allowed to capture full loads from the pile of material 112.

In a first decision block 202, it is determined if the bucket 110 has engaged the pile of material 112. Preferably, this determination is made by monitoring crowd factors, as described above.

When it is determined that the bucket 110 has engaged the pile 112, control proceeds to a first control block 204, in which an automated bucket loading process, such as the process described by Rocke in U.S. Pat. No. 5,968,103, is initiated.

In a second control block 206, the speed of the engine 106 is determined, preferably using an engine speed sensor (not shown), which is well known in the art. The actual engine speed is compared to full engine speed in a second decision block 208. If the actual engine speed is equal to full engine speed, the automated bucket loading process continues; for example, as described in Rocke. However, if the actual engine speed is determined to be less than full engine speed, control proceeds to a third control block 210.

In the third control block 210, the lift velocity is reduced in response to the actual engine speed being less than full engine speed. Preferably, the lift velocity is reduced by adjusting a lift velocity command to the work implement 108. In the preferred embodiment, the lift velocity is reduced in proportion to an amount of reduction in engine speed. For example, if it is determined in the second control block 206 that the actual engine speed is 82% of full engine speed, the lift velocity command, in the preferred embodiment, would be reduced to 82% of the full lift velocity command. However, it is to be understood that the reduction in lift velocity may be determined by other means as well, such as a table of velocity ranges, a non-linear reduction curve, and the like, without deviating from the spirit of the present invention.

In a third decision block 212, it is determined if the speed of the engine 106 has been reduced below a threshold value. If the engine speed is determined to be below a threshold, control proceeds to a fourth control block 214. In the fourth control block 214, the lift velocity is maintained at a predetermined threshold value. For example, if the threshold value of the engine speed is set at 65% of full engine speed, and it is determined that the actual speed of the engine 106 is some value below 65% of full engine speed, the lift velocity will be maintained at a minimum threshold value; for example, 65% of full lift velocity. The minimum lift velocity threshold value is determined to ensure adequate lift of the bucket 110 through the pile 112.

Industrial Applicability

As an example of applications of the present invention, a wheel loader is often used to dig, i.e., scoop, buckets of material from piles and dump the buckets of material at another location. For example, a wheel loader may be used to load gravel from a pile into trucks. As another example, a wheel loader may load loose material from blasting at an open pit mine site into trucks to haul the material away from the site.

In the above examples, the process of loading, carrying, and dumping is repetitive and is often performed for long periods of time. Therefore, it is desired to automate at least part of the process to maximize productivity and efficiency, and minimize fatigue and operator error. An automated bucket loading system and method, such as the system and method described above with reference to the patent by Rocke, works well for this purpose.

However, the automated bucket loading system and method, if designed to function with the engine at full speed, does not function as efficiently when the engine is operated at less than full speed. The present invention, therefore, improves the fundamental automated bucket loading system and method of Rocke by adjusting for variations in engine speed during the work process.

Other aspects, objects, and features of the present invention can be obtained from a study of the drawings, the disclosure, and the appended claims.

What is claimed is:

1. A method for automatically adjusting a process for automated bucket loading of a work machine having an engine and a work implement, the work implement including a bucket, including the steps of:

determining when the bucket engages a pile of material;

initiating the automated bucket loading process in response to the bucket engaging the pile of material;

determining an actual engine speed relative to a full engine speed; and adjusting a lift velocity command to the work implement, the lift velocity command adjustment being made as a function of a comparison of the actual engine speed to full engine speed.

2. A method, as set forth in claim 1, wherein adjusting a lift velocity command includes the step of reducing the lift velocity command as a function of the actual engine speed being reduced in comparison to full engine speed.

3. A method, as set forth in claim 2, wherein reducing the lift velocity command includes the step of reducing the lift velocity command in proportion to an amount of reduction in engine speed.

4. A method, as set forth in claim 3, wherein reducing the lift velocity command includes the step of maintaining the lift velocity command above a minimum threshold value.

* * * * *